US007694482B2

(12) United States Patent
Gazaway et al.

(10) Patent No.: US 7,694,482 B2
(45) Date of Patent: Apr. 13, 2010

(54) RETROFIT GLASS FRAGMENT CATCHING SYSTEM

(76) Inventors: Alan Scott Gazaway, 6157 Spring Way, San Jose, CA (US) 95123; Christopher Lewis Eder, 4125 Sparkleberry Ct., Prince Frederick, MD (US) 20678-3730; Norman Axel Mertke, 862 Windsor Hills Cir., San Jose, CA (US) 95123

( * ) Notice: Subject to any disclaimer, the term of this patent is extended or adjusted under 35 U.S.C. 154(b) by 1196 days.

(21) Appl. No.: 11/200,600

(22) Filed: Aug. 10, 2005

(65) Prior Publication Data

US 2006/0032160 A1 Feb. 16, 2006

Related U.S. Application Data

(60) Provisional application No. 60/601,379, filed on Aug. 13, 2004.

(51) Int. Cl.
*E06B 5/12* (2006.01)

(52) U.S. Cl. ..... 52/473; 52/202; 160/84.06; 160/172 R

(58) Field of Classification Search ..... 52/473, 52/1, 508, 202, 222; 89/36.04; 160/107, 160/34, 84.06, 172 R, 172 V
See application file for complete search history.

(56) References Cited

U.S. PATENT DOCUMENTS 2,819,499 A 1/1958 Abramson et al.
4,557,309 A * 12/1985 Judkins ..... 160/84.06
4,739,816 A * 4/1988 Dodich et al. ..... 160/168.1 R
4,932,710 A * 6/1990 Chen ..... 296/97.3
RE35,926 E * 10/1998 Hagen ..... 160/107
5,907,929 A 6/1999 Poma et al.
5,915,449 A * 6/1999 Schwartz ..... 160/330
6,010,758 A 1/2000 Anglin, Jr.
6,044,889 A * 4/2000 Liu ..... 160/172 R
6,057,029 A * 5/2000 Demestre et al. ..... 428/221
6,212,840 B1 4/2001 Davidovitz
6,216,401 B1 4/2001 Emek
6,298,766 B1 10/2001 Mor
6,319,571 B1 11/2001 Anglin, Jr.

(Continued)

OTHER PUBLICATIONS

PCT International Search Report and Written Opinion of the ISA from International Application No. PCT/US2/0050/28219 dated Sep. 24, 2007.

(Continued)

*Primary Examiner*—Phi Dieu Tran A
(74) *Attorney, Agent, or Firm*—Duane Morris LLP

(57) ABSTRACT

A blast resistant window blind system includes a blind system comprising a plurality of parallel blind slats, a plurality of spaced pane engaging members, and first and second mounting bodies coupled to the pane engaging members and anchor members disposed at first and second opposite ends of said opening, wherein the pane engaging members are secured to the mounting bodies and coupled thereby to the structure. At least one energy dampening device is coupled to the pane engaging members, allowing the pane engaging members to extend a selected amount toward the inside of the structure upon impact of the window pane, wherein the blind system and pane engaging members cooperate to restrain the window pane from being blown into the inside of the structure and conform to the inside surface of the window pane during impact therewith to distribute the restraining force across the window pane.

16 Claims, 11 Drawing Sheets

U.S. PATENT DOCUMENTS

| | | | | |
|---|---|---|---|---|
| 6,333,085 | B1 | 12/2001 | Emek | |
| 6,338,377 | B1 * | 1/2002 | Domel | 160/84.02 |
| 6,349,505 | B1 * | 2/2002 | Figge et al. | 52/1 |
| 6,385,924 | B1 | 5/2002 | Emek | |
| 6,494,000 | B1 | 12/2002 | Emek | |
| 6,497,077 | B1 | 12/2002 | Emek | |
| 6,502,356 | B2 | 1/2003 | Emek | |
| 6,509,071 | B1 | 1/2003 | Emek | |
| 6,530,184 | B1 | 3/2003 | Emek | |
| 6,536,174 | B2 | 3/2003 | Foster et al. | |
| 6,604,322 | B2 | 8/2003 | Horn et al. | |
| 6,648,048 | B2 * | 11/2003 | Lai | 160/115 |
| 6,718,705 | B2 | 4/2004 | Emek | |
| 6,764,728 | B2 | 7/2004 | Emek | |
| 6,796,360 | B2 * | 9/2004 | Ferrie et al. | 160/172 R |
| 6,907,710 | B2 | 6/2005 | Trundle | |
| 7,036,279 | B2 * | 5/2006 | Crozzoli | 52/213 |
| 2004/0025453 | A1 | 2/2004 | Coddens | |

OTHER PUBLICATIONS

Window Film® Architectural, Auto, Decorative, Security, vol. 7, Issue 1, Jan.-Feb. 2003, http://www.usglassmag.com/Film/BackIssues/Jan-Feb03/noteworthy.html, 2 pages.

Valentin Shustov, PhD., P.E., "Sails-Rigging Blast Protective Structural Shield," Structural Research Detail, California State University Northridge, College of Engineering & Computer Science, Dept. of Civil & Manufacturing Engineering, May 24, 2001, 10 pages.

"Security Blinds Ltd.," Product Development Projects, Sheffield Hallam University Engineering Services to Industry, www.shu.ac.uk/schools/eng/industry/productsblinds.html, accessed Nov. 11, 2005, 2 pages.

Robert Smillowitz, Retrofitting Existing Buildings to Resist Explosive Threats, WBDG Whole Building Design Guide, www.wbdg.org/design/retro_rstexplo.php, updated Apr. 1, 2005, National Institute of Building Sciences, 9 pages.

James L. O'Daniel et al., Numerical and Experimental Evaluation of Blast Retrofit of Windows, 16$^{th}$ ASCE Engineering Mechanics Conference, University of Washington, Seattle, Jul. 16-18, 2003, 12 pages.

"Retrofits for Existing Windows to Protect Occupants from Injurious Debris Due to a Bombing," Karagozian & Case, presented at 71$^{st}$ Shock & Vibration Symposium, Nov. 2000, Arlington, VA, pp. 1-8.

Eileen McMurrow, "Life Safety: Curtain Wall, The Glass Shield," McMorrow report.com, Trends for Facilities, Real Estate & Outsource Management, © 2003-2005 McMorrow Report LLC, 2 pages.

Advanced Solutions, Advanced Protection, "Cable System," www.al-sorag.co.il/page15.html, accessed Nov. 10, 2005, 3 pages.

Douglas A. Sunshine et al., "TSWG Blast Mitigation Program," (undated), 13 pages.

Energy Absorbing Retrofit System for Mitigating Blast Effects on Occupants of Conventional Buildings, Karagozian & Case, submitted to 29$^{th}$ Explosives Safety Seminar, New Orleans, LA, Jul. 2000, pp. 1-10.

Fabric Catcher System® product information, GSA, www.mechoshade.com/site/gas/fabric_catcher.cfm, accessed Nov. 11, 2005, 1 page.

Fema—Building Design for Homeland Security: Resident Course, Unit IX: Building Design Guidance, Visual IX-28 Blast Curtains and Visual IX-29 Catch Bar, (undated), 1 page.

Multi-Hazard Window (Glazing) Retrofit Design, document No. 6025, ER One, Facility Multi-Hazard Mitigation, May 5, 2002, 8 pages.

Matico FrameGaurd Test Report, Explosion Range Testing, ComBlast 2002, Aug. 20, 2002, 15 pages.

Airblast Protection Retrofit for Annealed Glass Windows, Dept. of the Army, U.S. Army Corps of Engineers, Technical Letter No. 1110-x-xxx, Oct. 26, 1998, 16 pages.

FM3-19.30 (formerly FM 19-30) Physical Security, Headquarter, Department of the Army, Washington, DC, Jan. 8, 2001, pp. 1-317.

Aluminum Security Mesh, Solomon Security and Blinds, © 2002, www.solomonsecurityandblinds.com.au/security_allow_mesh_pat, 1 page.

Darrell D. Barker, P.E. et al., Summary Report, Test Program for Evaluation of Filmed Windows Subjected to Blast Loads, WBE Project 817-001, prepare for CHB Industries, Inc., Jan. 1997, pp. 1-8.

Darrell D. Barker, P.E. et al., Summary Report, Test Program for Evaluation of Filmed Windows Subjected to Blast Loads Phase II, WBE Project No. 875-01, prepared for CHB Industries, Inc., Aug. 1997, pp. 1-13.

Wayne B. Ashbery, U.S. Department of State Approach to Physical Security as Related to Blast Mitigation, (undated), 8 pages.

Letter to Joseph L. Smith, Applied Research Associates, Inc. from CHB Industries forwarding Testing Summary of Hardglass 10 Mil 3-Ply Security Window Film by Wilfred Baker Engineering, Inc., Oct. 27, 1997, 11 pages.

Excerpt from design specification for a glazing blast mitigation project for Shell Chemical Co. drawn up by EQE International, 1990s, 7 pages.

* cited by examiner

RETROFIT GLASS FRAGMENT CATCHING SYSTEM

CROSS-REFERENCE TO RELATED APPLICATION

This application claims priority to U.S. Provisional Patent Application Ser. No. 60/601,379 entitled "Retrofit Glass Fragment Catching System" filed Aug. 13, 2004, the entirety of which is hereby incorporated by reference herein.

FIELD OF THE INVENTION

The present invention relates to blast protection systems, and more particularly to blast protection systems for windows.

BACKGROUND OF THE INVENTION

Physical security for buildings, offices, residences, etc. is a growing concern. One such security concern is damage caused by explosions, such as a bomb detonation, that may occur exterior to a structure. Though a building's inherent structural integrity can often mitigate the impact of some types of explosions, the impact can actually be aggravated by the presence of windows in the building. Glass shards from breaking windows can cause substantial damage and injury to persons and property inside a building even if the structural damage to the building is minimal. It has been reported that glass shrapnel from shattering windows causes over eighty percent (80%) of the serious injuries in a bomb blast event.

Many useful devices have been developed to secure and protect structures from blast events. These devices can be divided into two broad categories: (i) replacement of the existing glass and framing window system with a blast resistant window system, and (ii) installation of a retrofit product or products onto or in front of the existing glass and framing system on the interior of the building, while keeping the original window unit in place.

Typically, the most effective method is to completely replace the existing window system with a blast resistant window system designed specifically for the building's structure and the estimated blast load; however, it can be cost prohibitive to treat an entire building in this manner. Another option is to install retrofit products such as fragment retention films that can be anchored to the existing window frame; however this approach has its own limitations and may not be a viable option for many reasons, such as, for example: (i) hardening the window with current retrofit treatments may actually cause greater structural damage to the building in a blast event; (ii) the window, glass, or frame construction may not allow hardening using current retrofit treatments; or (iii) the available retrofit treatments that are technically possible are not aesthetically acceptable.

The typical minimum protection technique for retrofitting windows is to apply a fragment retention film (FRF) or shatter-resistant window film (SRWF) (collectively, "blast protection film") to the visible portion of the glass in what is termed a "daylight configuration." Although the fragment retention film will hold the glass shards together during a blast event, the window will fly into the room as one piece, possibly causing blunt trauma injury.

In many cases, the fragment retention film can be anchored to the existing window frame using various techniques. This application usually is sufficient for low level blasts if the existing window frame has sufficient structural integrity to accept the blast load generated by the film and anchoring system. In some window systems, however, it is not feasible to install an anchored fragment retention film. Therefore other retrofit fragment retention film configurations must be used in conjunction with products that catch the filmed glass after it leaves the window frame in a blast event.

In the mid 1990s, the US Army Corps of Engineers developed a retrofit "catchbar system" that consisted of a steel tube placed across a window and mounted securely into the structure's wall. The window glass was treated with a fragment retention film. During a blast, the bar literally caught the filmed glass as it exited the window frame. The US Army Corps of Engineers published its blast results and design in an Engineering Technical Letter for use by manufacturers, designers, and end users describing the design and implementation of this concept. This method worked well for lower blast pressures, but at higher blast pressures the film tore from impact with the rigid catch bar, allowing two pieces of filmed glass to fly into the room.

A solution to this problem was developed in the form of a deployable catchbar. The deployable catchbar system consists of a catchbar which contains and conceals a steel cable that is fastened on each end to the window frame or to the building's structure as appropriate. In a blast, the filmed glass is blown into the catchbar, which is mounted an inch or two from the glass window on the inside of the building. The catchbar engages the glass and exits the frame as well; however, the steel cable allows the catchbar to travel a short set distance but then stops the catchbar and glass sheet from traveling any further. The advantage of this system is that it allows the blast pressure to vent around the glass sheet and decelerates the glass sheet less abruptly. The assignee of the present application blast tested this product and presented its results to the Protective Glazing Council Symposium in 2000 at the General Services Administration (GSA) Headquarters Building in Washington, D.C. Many variations of this product have been developed and sold by different manufacturers. Some manufacturers even use a cable or strap system without the catchbar depending on the design blast load and aesthetics.

The catchbar concept, while effective, does has some drawbacks. Its effectiveness depends on the number of catchbars mounted across the window, and even the deployable version may cause the filmed glass to split where the catchbar engages the filmed glass in large blasts, at least with bare cable catchbars. Also, this approach is relatively ineffective when used in conjunction with insulating glass since only the interior pane is treated with fragment retention film.

Accordingly, there remains a need for an improved glass catching assembly, and particularly a retrofit glass catching assembly for installation over standard windows without requiring replacement of the window glass, panes or window frames with blast resistant designs.

SUMMARY OF THE INVENTION

A blast resistant window blind system for installation over a reinforced window pane supported by a window framework mounted in an opening in a wall of a structure, the window pane having an inside surface facing an inside of the structure and an outside surface facing an outside of the structure is provided comprising a blind system comprising a plurality of parallel blind slats. A plurality of spaced pane engaging members are disposed to extend across the inside surface of the window. First and second mounting bodies are secured to the pane engaging members and configured to couple to anchor members disposed at first and second opposite ends of the opening, whereby the pane engaging members are coupled to the structure. A plurality of anchor members is coupled to the mounting bodies. The system includes at least one energy dampening device coupled to the pane engaging members, the energy dampening device allowing the pane engaging members to extend a selected amount toward the inside of the structure upon impact of the window during a blast event, wherein the blind system and pane engaging members cooperate to restrain the window pane from being blown into the inside of the structure and conform to the inside surface of the window pane during impact therewith to distribute the restraining force across the inside surface of the window pane.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

The present invention is directed to all types of windows: casements or operable windows, fixed windows, sliding windows, curtain walls, secondary interior windows, and other types.

Embodiments of a blast resistant window blind system are provided herein. In one embodiment, the blast resistant window blind system can be retrofitted over an existing window pane or panes in a structure, however the system can also be installed as part of an original construction. Preferably, the pane or panes of a window supported by a frame are treated in some manner to prevent (or reduce the likelihood of) the pane(s) from shattering into multiple projectiles during a blast event. For example, the pane(s) can be reinforced with a blast protection film or comprise laminated glass, the details of which are familiar to those in the art and are not repeated herein so as to avoid unnecessarily obscuring the details of the present invention.

Figure 1A:
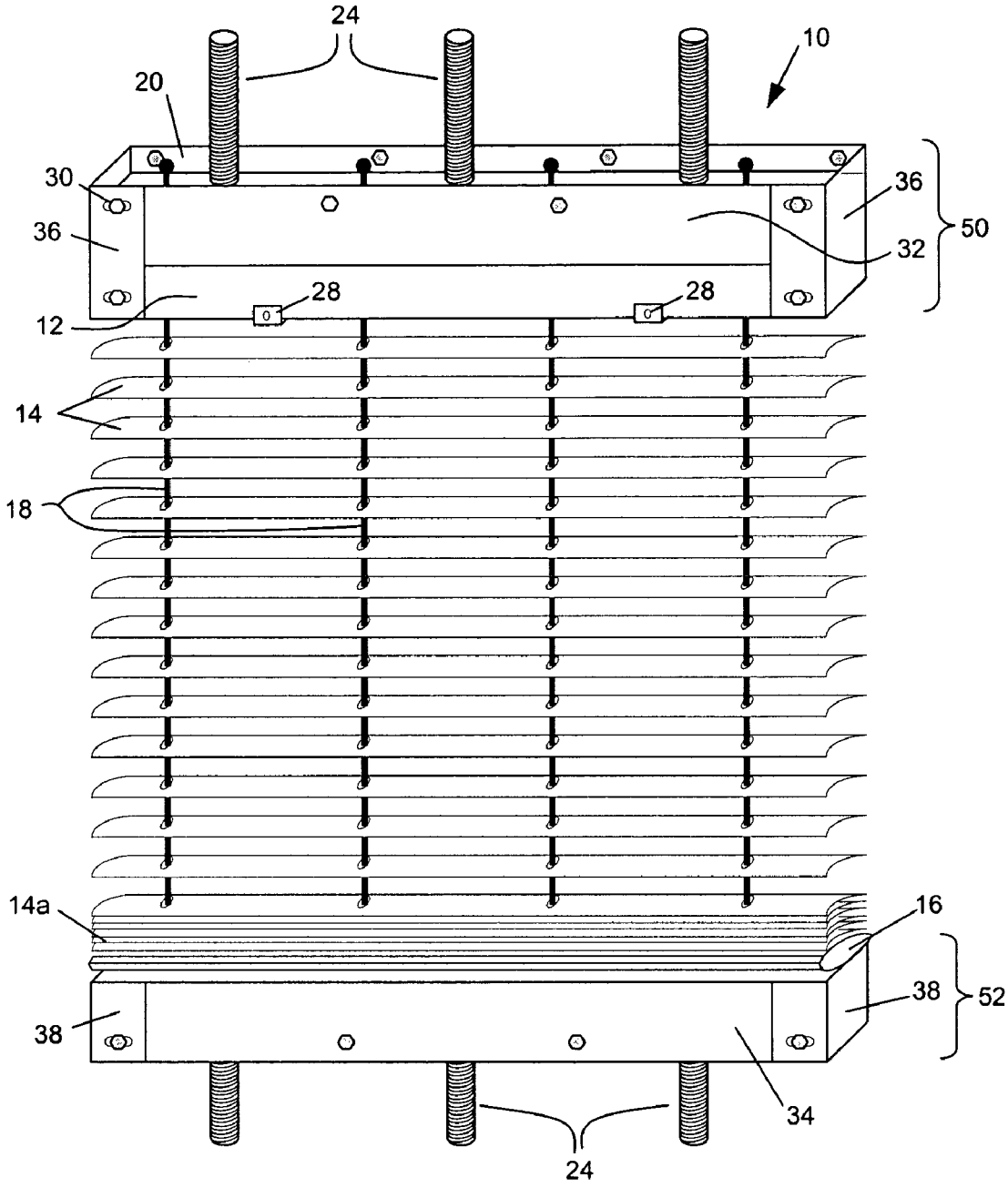
FIG. 1A is a perspective view of a blast resistant blind system for installation over a window at an interior side thereof.
Figure 1B:
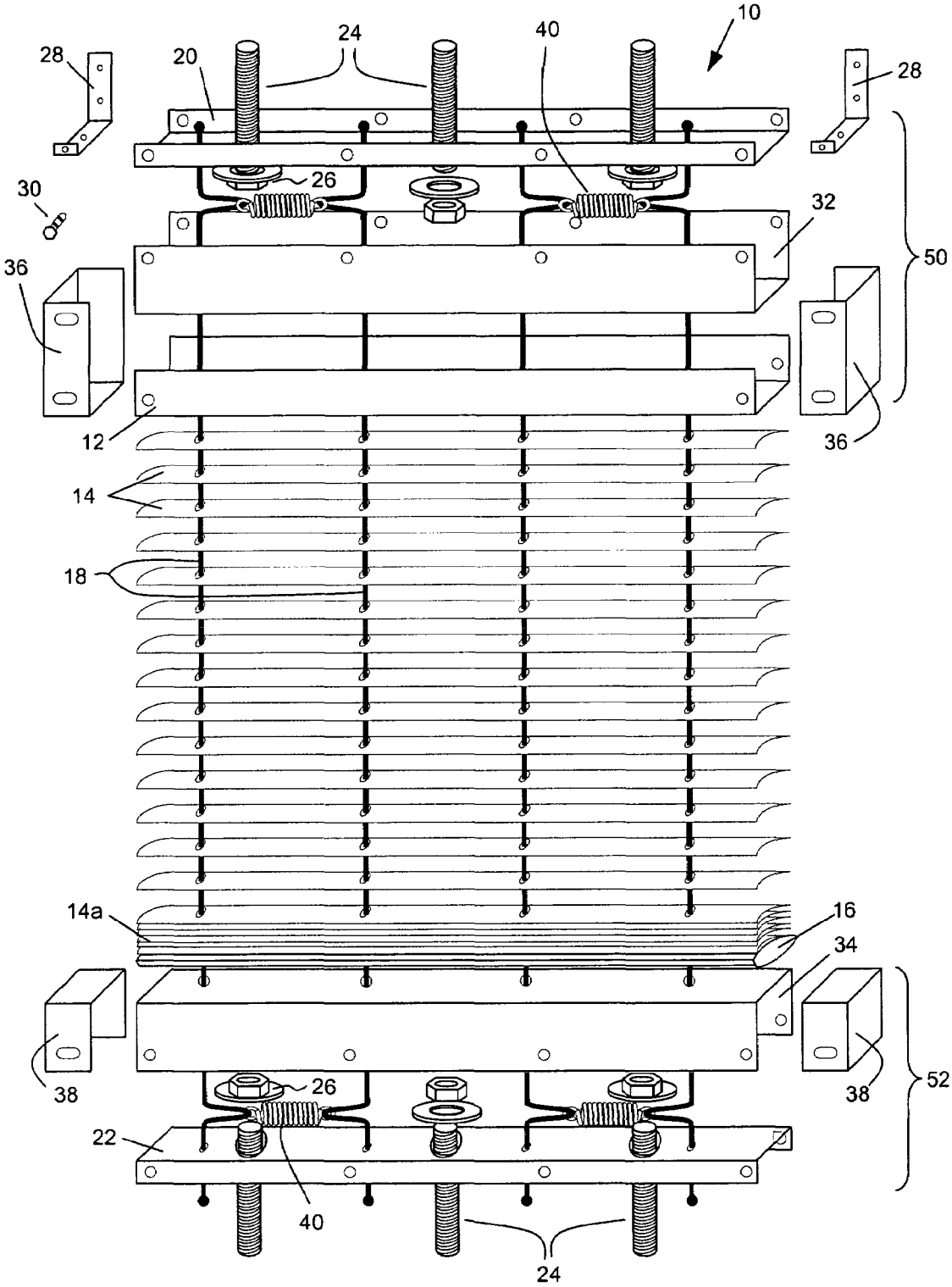
FIG. 1B is an exploded view of the blast resistant blind system of FIG. 1A.

FIG. 1A is a perspective view of an exemplary embodiment of a blast resistant blind system 10. FIG. 1B is an exploded view better showing the individual components of the exemplary blast resistant blind system 10 of FIG. 1A. The system 10 includes a conventional blind system, such as the illustrated horizontal blind system including conventional blind header rail 12, conventional blind footer rail 16, and a plurality of conventional blind slats 14. In one embodiment, extra blind slats 14*a* are provided for expansion with deployable blast cables 18 (discussed below) during a blast event. Although not illustrated, the blind system is preferably provided with conventional actuating hardware, such as the cord tilt gears, ladder drums, and drum cradles for rotating the blind slats and the cord and cord lock to raise and lower the blinds. Some of this hardware may be enclosed within the blind header 12 and some may be exposed.

The blast resistant blind system 10 is assembled and installed over a window in an opening of a structure at the inside side of the window/structure, so that the window pane (s) is blown into the blast resistant blind system 10 by a blast occurring outside of the structure. Throughout this description, this opening is sometimes referred to as a "frame" having header, footer and jamb members. It should be understood that the frame can be defined by the structure wall itself or the structure wall in combination with other construction elements generally forming a support framework for the window pane or panes.

The system 10 includes upper and lower mounting assemblies 50, 52. The upper mounting assembly 50 includes an upper mounting body, such as load bearing rail 20, that couples to the top end (i.e., header) of an opening in a wall, a U-shaped enclosure 32 for housing/covering the tensioner connection between adjacent vertical deployable cables 18 and receiving the load bearing rail 20, end caps 36 and, optionally, blind header rail mounting clip 28, which is generally "L" shaped. In exemplary embodiments, the load bearing rail 20, the U-shaped enclosures 32, and end caps 36 are aluminum components. The cables 18 and mounting clips 28 are preferably steel components. These components are assembled together and secured to one another with screws, bolts 30 and mating nuts (not shown) or other fastening means.

The lower mounting assembly 52 is similar to the upper mounting assembly 50 but does not include blind header mounting clips 28. The lower mounting assembly 52 includes a lower mounting body, such as load bearing rail 22, which couples the system to the lower end (i.e., footer) of the wall opening, a U-shaped enclosure 34 for housing/covering the lower connections between adjacent vertical deployable cables and receiving lower mounting load bearing rail 22, and end caps 38.

The system 10 includes a plurality of anchor members, preferably including a plurality of spaced upper and lower anchor members, for securing the system to the structure. In one embodiment, these anchor members comprise a plurality of mounting bolts 24 (also known as studs) and mating nuts/washers 26 disposed through holes (preferably oval shaped holes) in the load bearing rails 20, 22 and driven into the wall of the structure. These anchor members secure the blast resistant blind system 10 firmly to the structure during a blast event, allowing the blind system to catch a projected window pane(s) and dissipate the force of the blast, as described below in more detail.

The blast resistant blind system 10 also includes a deployable catch system that receives a window that is blown from its framework and dissipates that force of the impact of the reinforced glass pane(s) and the blast by expanding with the blast a set amount and by allowing the blast to vent around, over and under the blind system. In an exemplary embodiment, the catch system includes a plurality (four are shown in FIGS. 1A and 1B) of vertically extending spaced deployable cables 18. Adjacent pairs of cable sections 18 are coupled together proximate to their ends by energy dampening devices, such as tensioning devices (e.g., tensioning springs 40) or energy wasting devices. Cables 18 are preferably high strength and highly flexible galvanized or stainless steel cables. The cables may additionally have a colored vinyl coating for aesthetic purposes.

The springs 40 keep the cables in tension to they stay straight, in a visually appealing orientation. The springs 40 also allow the cables to deploy, which vents the blast pressure. Finally, the springs 40 smooth out the impulse blast, i.e., spread out in time the "yank" exerted by the cables on the anchors so the cables and anchors can be less heavy duty.

In an exemplary embodiment, the tensioning springs 40 are "hobby horse" springs suspended between two adjacent cables 18. The spring characteristics (coil size, coil length, material and resistance factor) are calculated or selected based on factors discussed below. This configuration is easy to assemble and allows the cables to adjust the load between each pair during a blast event, thereby equalizing the pressure on the glass sheet. The length of the cables 18, the spacing and number of cables 18, the spacing and number of anchors 24, the length and number of tensioning devices (e.g., springs 40), the number and spacing of slats 14, and the physical specifications of the springs 40 can be varied depending on the desired blast resistance and the size of the window or window opening. Other factors include the thickness of the glass, the thickness of any blast retention film on the glass, the expected blast load, the size of the anchors 24 and the strength of the building substrate. As an example, a window opening 48 inches wide by 66 inches high that needs to meet a government Performance Condition 3 (also known as a "High Protection Level") in a medium blast loading of a peak pressure of 4 psi and an impulse of 28 psi-msec (commonly referred to as a GSA Level C blast load) may utilize a blast blind system that incorporates four ⅛-inch diameter vertical steel cables equally spaced 12 inches apart. A window opening 61 inches wide by 49 inches high that needs to meet a Performance Condition 3 in a much higher blast loading with a peak pressure of 10 psi and an impulse of 89 psi-msec (commonly referred to as a GSA Level D blast load) may utilize a blast blind system that incorporates six ⅛-inch diameter vertical steel cables equally spaced 11 inches apart These configurations were installed over a window pane treated with fragment retention film and successfully tested (as described below in more detail) to the required performance.

The cable length, spacing and tensioning device are preferably selected so that the cables are taut in their quiescent (i.e., non-extended) state. The tensioning device allows the cables to travel inward with a blown glass sheet, allowing venting, dissipation, and distribution of the blast pressure, thereby preventing the anchors from being pulled out of the building structure.

In alternative embodiments, cables 18 are replaced with other elements that could perform substantially the same deployment function, such as metal rods, steel wire, or high strength/high elongation synthetic or non-synthetic straps or cords. These restraint elements are collectively referred to as "pane engaging members." Also, although the adjacent cable sections are shown as individual cables, a single loop (or even serpentine path) of cable may be used to form a pair of adjacent cable sections (or even pairs of adjacent cables) in alternative embodiments.

Although the tensioning device or tensioner is shown as a tensioning spring 40, other elements may also be utilized. In one alternative embodiment, the tensioner may comprise a piston in a cylinder with a restricting viscous fluid or aperture with restricted dimension for escape of compressed fluid. A pair of coiled compression springs that operate against opposite walls of a housing may also be used or other element capable of elastic deformation. It may also be possible to use elements that are not reusable, such as elements that are capable of plastic deformation or sequential shearing ring energy wasting devices, such as those described in U.S. Pat. Nos. 6,497,077 and 6,494,000 to Emek, the entirety of which are hereby incorporated by reference herein. Alternatively, individual tensioners or energy wasting devices can be coupled along a length of cable, such as described in the Emek patents, as opposed to between adjacent parallel lengths of restraining cable.

Figure 2:
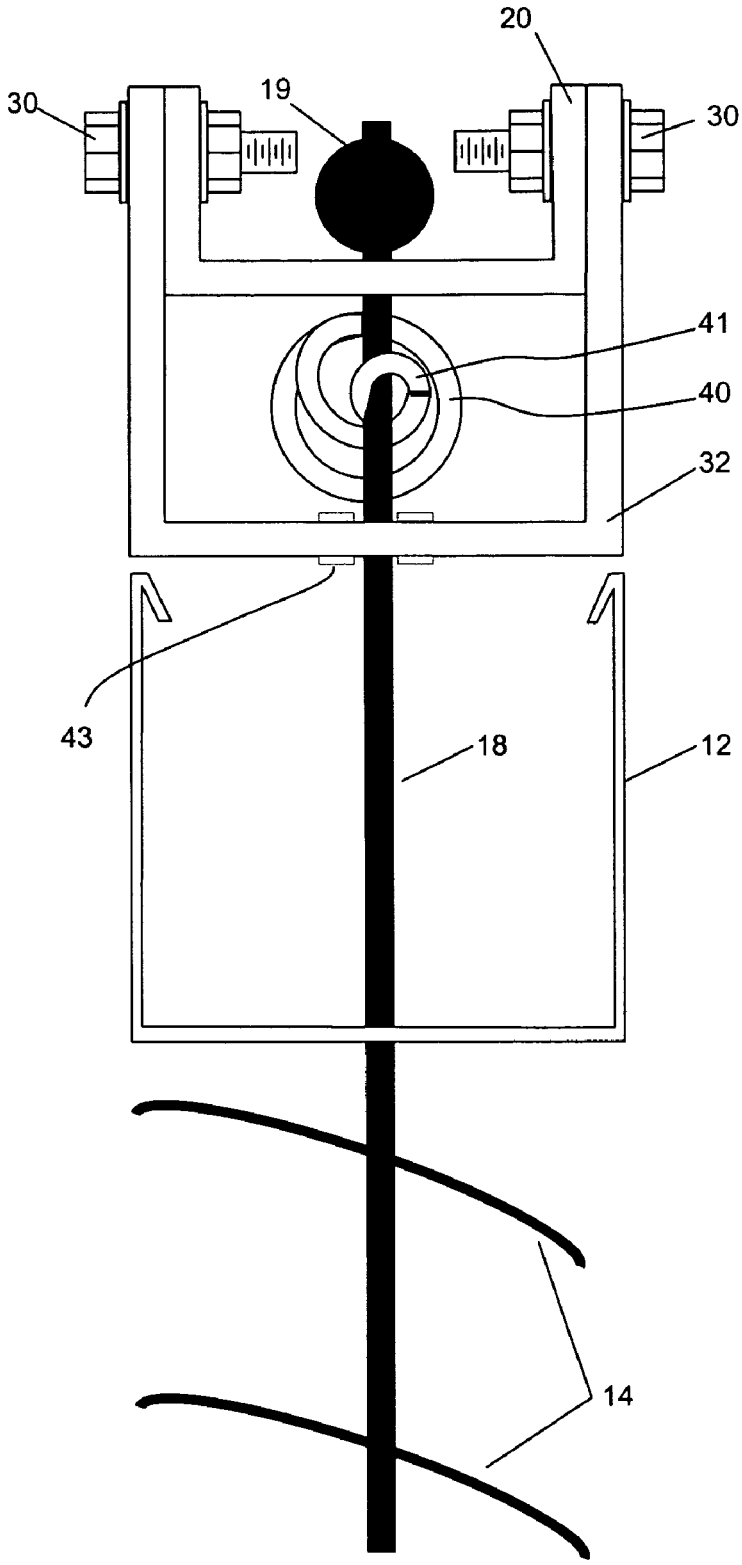
FIG. 2 is an enlarged side elevation view of a top portion of the blast resistant blind system of FIGS. 1A and 1B.

FIG. 2 shows an enlarged partial side elevation view of a top portion of the blast resistant blind system 10. FIG. 2 shows blind slat 14, blind header rail 12, U-shaped enclosure 32 and load bearing rail 20 fitted in enclosure 32. Anchors 24 are not shown. As can be seen from this drawing, load bearing rail 20 and enclosure 32 are preferably thicker than blind header rail 12, as they (in cooperation with anchors 24) must securely hold the blind system 10 to the structure against a blast force. The ends of the cables 18 are provided with ball swages 19 or other cable termination assembly, which are familiar to those in the art, in order to secure them within the rail 20 (and rail 22 (not shown in FIG. 2)). The cable sections 18 are secured to tensioning springs 40 by a simple crimped loop 41. The enclosure 32 is provided with grommet 43 in the pass through-hole through which the cable 18 is placed. Grommets 43 reduce friction against the cables 18 during deployment.

Figure 2A:
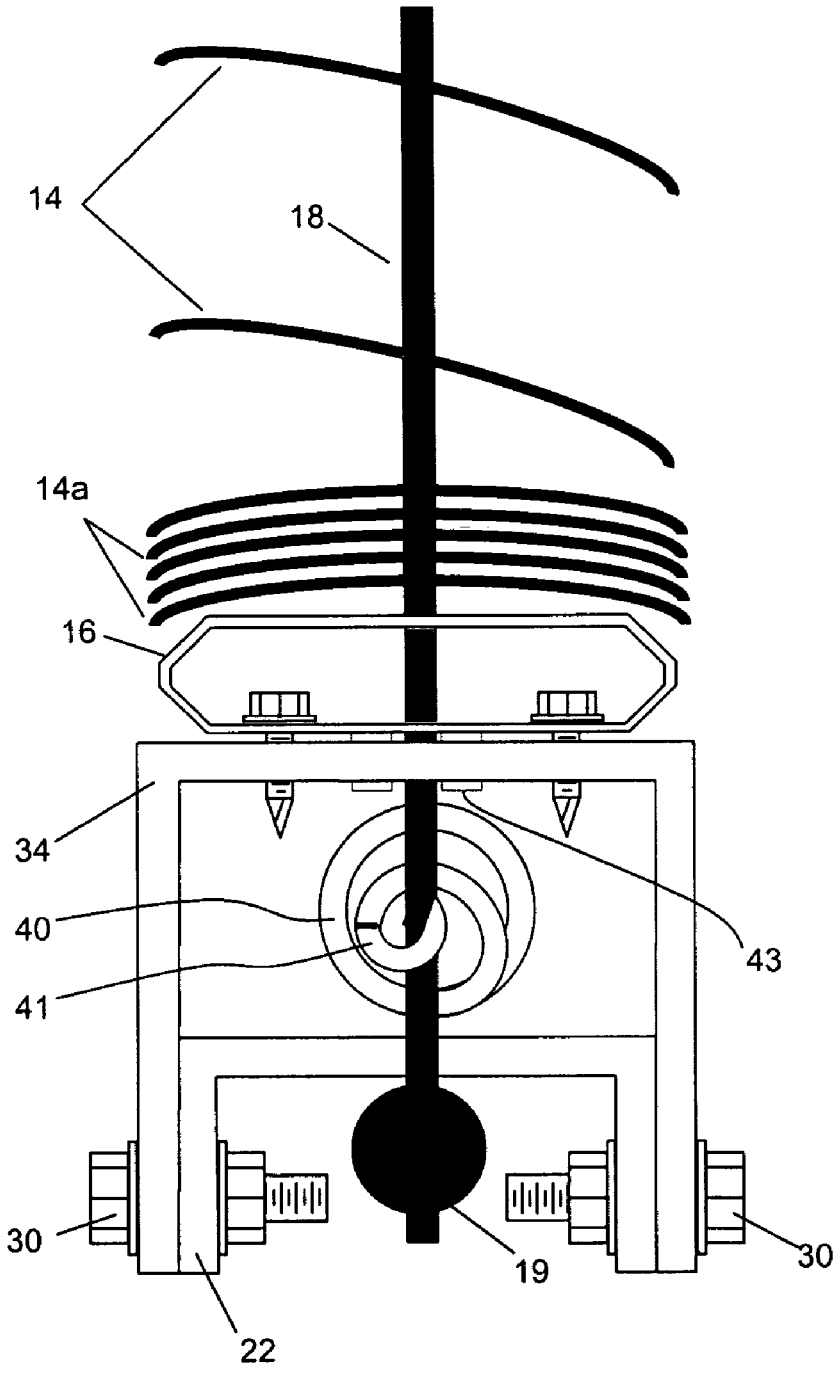
FIG. 2A is an enlarged side elevation view of a bottom portion of the blast resistant blind system of FIGS. 1A and 1B.

FIG. 2A shows an enlarged partial side elevation view of a bottom portion of the blast resistant blind system 10. This view clearly illustrates blind footer section 16 secured to the bottom mounting enclosure 34, as discussed in more detail below when describing the assembly and installation of the blast blind system 10.

Figure 3:
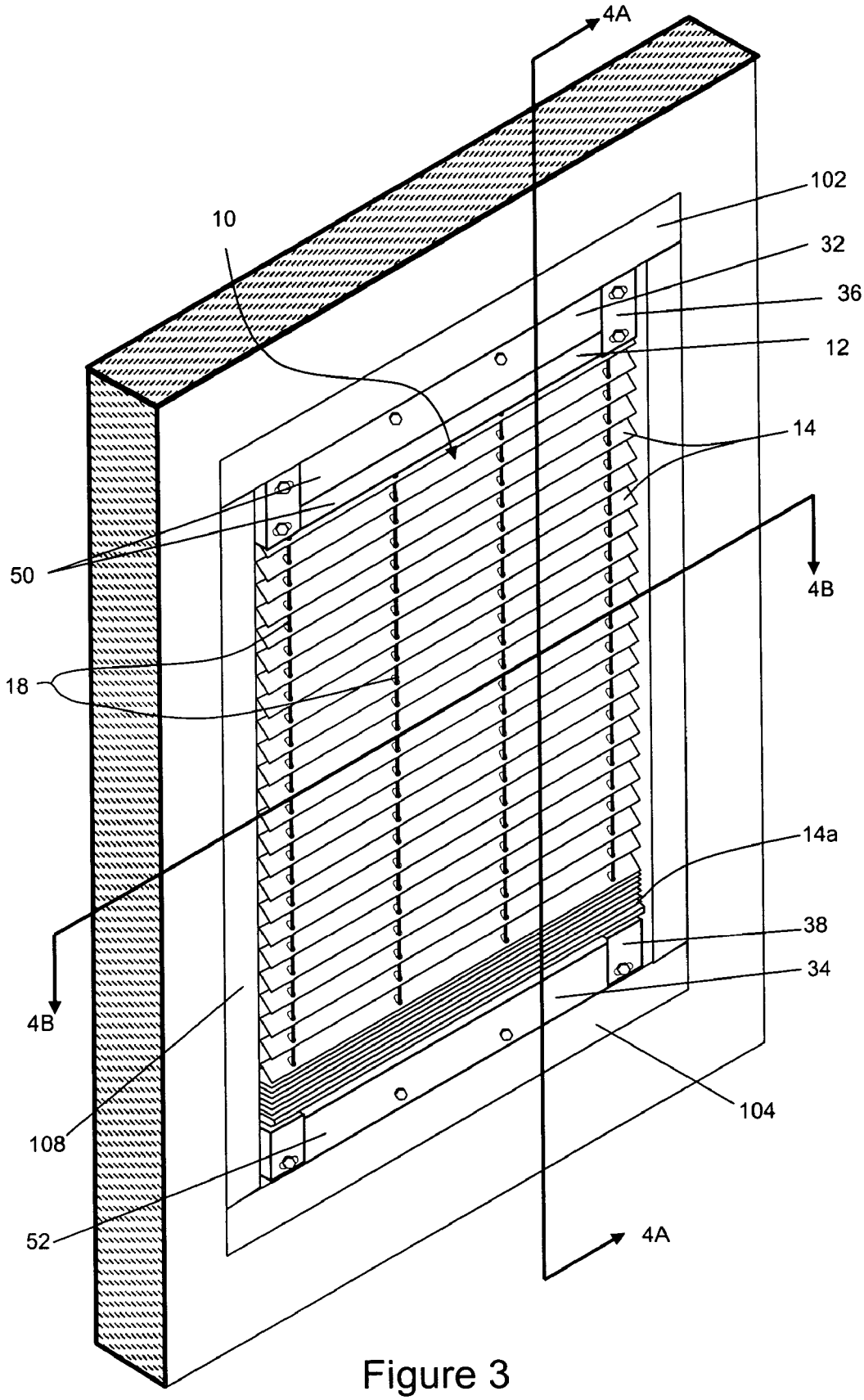
FIG. 3 is a perspective view of the blast resistant blind system of FIG. 1 installed in a wall of a structure.

FIG. 3 is a perspective view of a blast resistant blind system 10 installed in an opening of a wall over a window. The window includes a glass pane that is secured in a frame including header 102, footer 104 and jamb members 106 and 108.

Figure 4A:
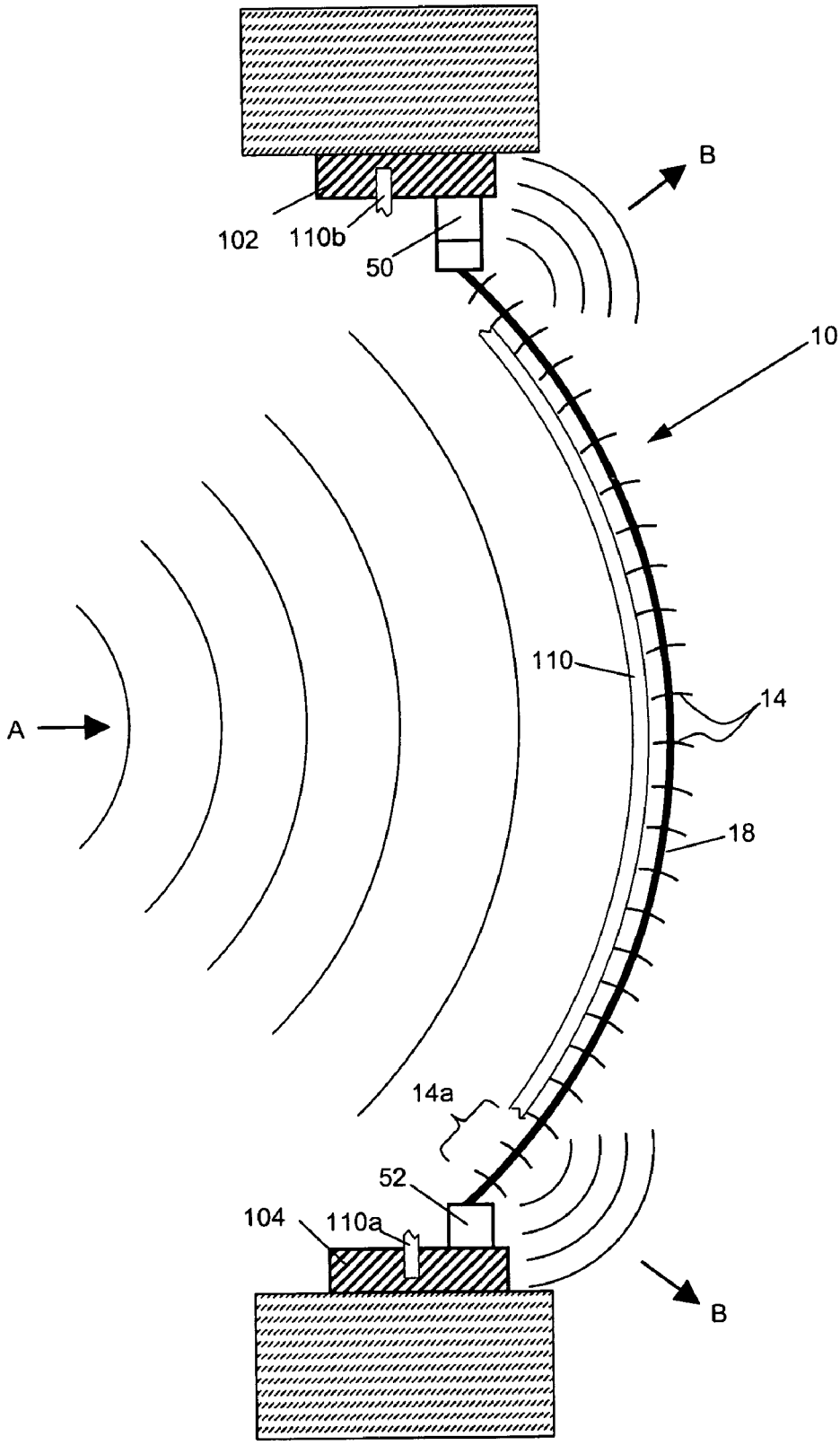
FIG. 4A is a cross-sectional view taken along line 4A-4A of FIG. 3 of the installed blast resistant blind system during a blast event.
Figure 4B:
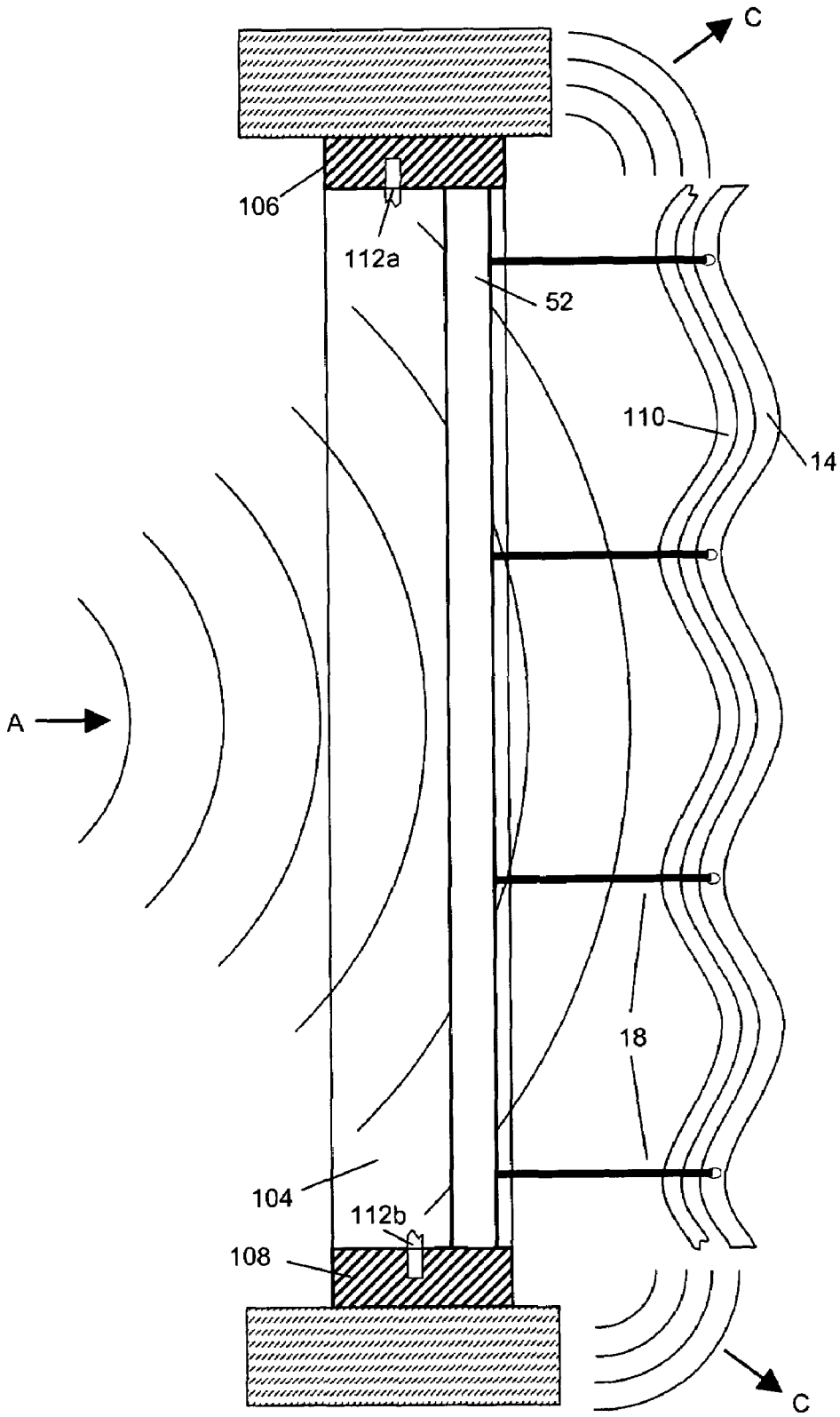
FIG. 4B is a cross-sectional view taken along line 4B-4B of FIG. 3 of the installed blast resistant blind system during a blast event.

FIGS. 4A and 4B show the operation of the blast resistant blind system 10 during a blast event represented by blast pressure wave "A." FIG. 4A is a cross-sectional view taken along lines 4A-4A of FIG. 3 of an installed blast resistant blind system 10 during a blast event. In this illustrated embodiment, a window pane 110 located between header 102 and footer 104 reinforced with a fragment retention film to work in conjunction with the blast blind system. Blast pressure A from outside of a structure causes window pane 110 to break from its framework, leaving portions 110*a*, 110*b* in the framework. The panel 110 is blown into and caught by the blast blind system 10, where the cables 18 extend by means of the tensioning springs 40 housed in the mounting assemblies 50, 52 and extra cable length. The cables 18 extend to catch the pane 110 and dissipate some of the force of the blast. The blind slats 14, through which the cables pass, while being aesthetically pleasing, also serve to advantageously distribute the blast pressure across the blind system. The blind system conforms to the filmed (or otherwise reinforced) glass sheet 110 in an arc shape, distributing the resisting force evenly to the filmed glass, preventing the glass and film from tearing and transferring evenly the load to the anchors in the structure. The blind slats 14 and cables 18 essentially form a coherent net for catching the blown reinforced glass sheet and evenly distributing the catch resistance across the sheet. Still further, the expansion of the cables and blinds, while accepting, dissipating and dispersing the force of the impact of the window pane 110, also creates space above and below the slats 14 through which the blast pressure can vent around the blind system (shown as blast pressure waves "B").

FIG. 4B is a top cross-sectional view of the installed blast resistant blind system 10 operating during the blast event taken along lines 4B-4B of FIG. 3. FIG. 4B shows broken window pane 110 blown into horizontal slats 14 and extended cables 18. Vertical window portions 112*a*, 112*b* are shown left in jamb members 106, 108 respectively. In addition to allowing the blast pressure to disperse over and under the blind system (as shown by dispersing pressure waves B in FIG. 4A), the expansion of the cables 18 and blind system also allows the blast pressure to escape around the side of the blind system, as shown by escaping pressure waves "C" in FIG. 4B.

Figure 5A:
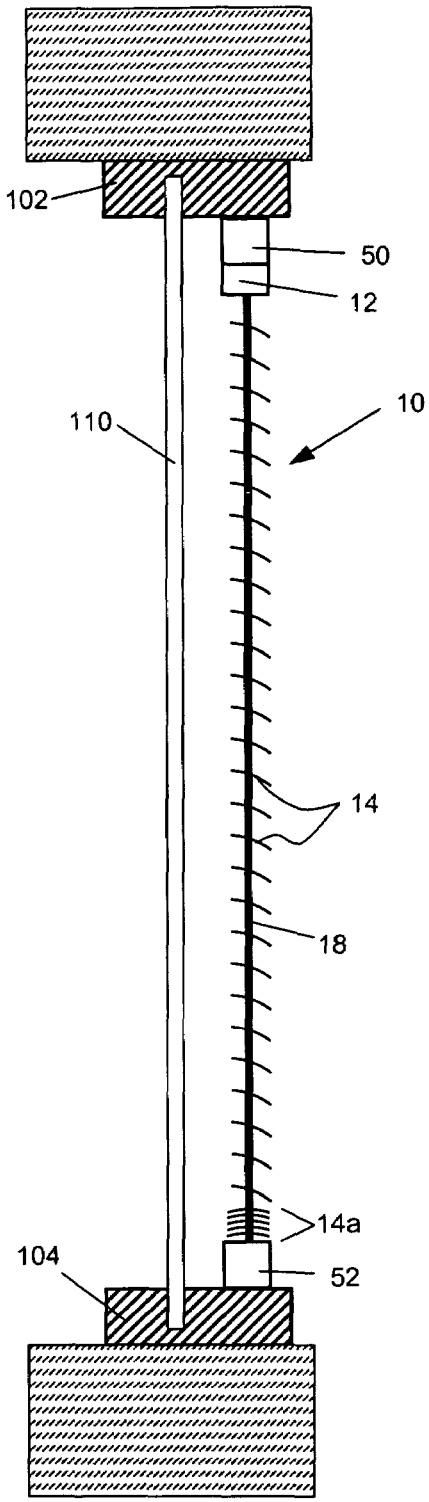
FIGS. 5A and 5B are side elevation views showing alternative mounting configurations for a blast resistant blind system.
Figure 5B:
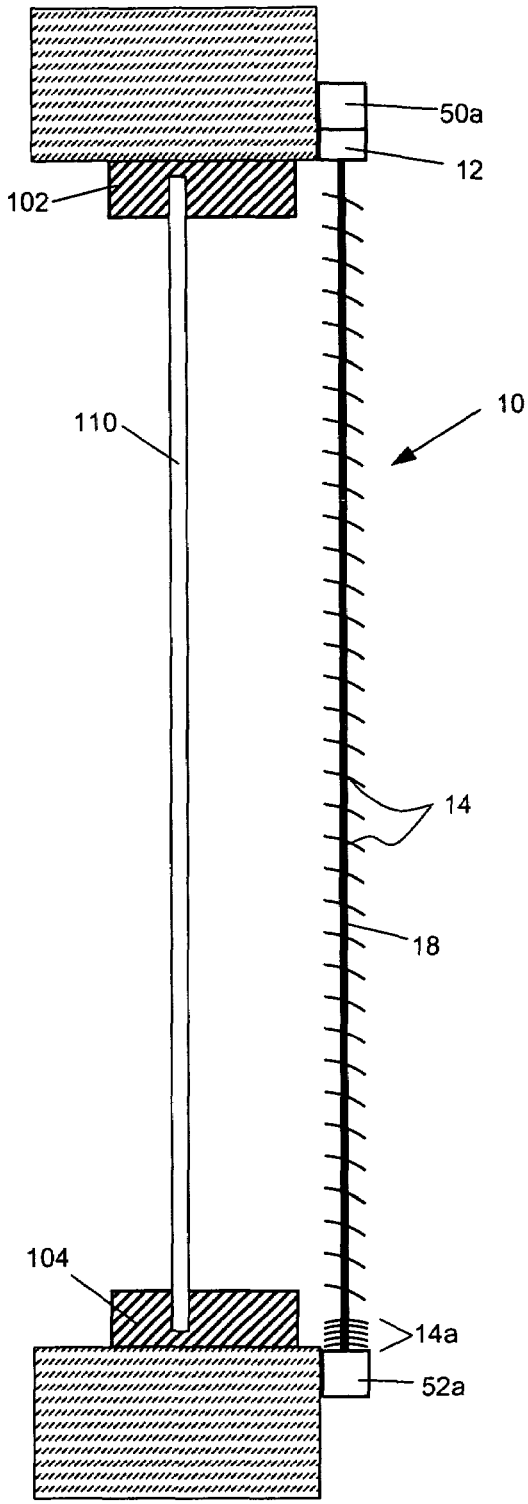

FIG. 5A is a side view of an installed window frame system 10 (with vertical frame members 106, 108 not shown). As described and shown above in FIGS. 1-4, the mounting assemblies 50, 52 are attached to the major surfaces of the header and footer sections 102, 104 of the opening in the wall of the structure. This installation can be referred to as an "inboard" mount configuration. In an alternative embodiment, shown in FIG. 5B, mounting assemblies 50*a*, 52*a* are provided and secured to the inside surface of the wall having the window opening formed therein. The mounting assemblies 50, 52 and 50*a*, 52*a* are essentially the same except that anchors are driven into the wall parallel to opening therein in assemblies 50, 52, whereas the anchors are driven essentially perpendicular to the opening in the wall in assemblies 50*a*, 52*a*. This installation can be referred to as an "outboard" mount configuration. It should be understood that the mounting configuration depends on the existing window and building structure and the method used to couple the cables to the building structure. The size of the installation will be slightly different for a given window depending on the mount configuration used, however the fabrication of the system and measuring process are very similar.

An exemplary measurement, fabrication and installation processes are described hereafter for an "inboard" mount configuration using horizontal blind slats and vertical retention cables. These processes are similar and need not be detailed herein for outboard installations and for systems (detailed below) utilizing horizontal cables and vertical blind slats. To determine the width of the blinds, window width measurements are taken at the top, middle and bottom of the window to the closest ⅛ inch. The smallest width less one inch is used for fabrication calculations. Measurements are taken at these three locations since it is common for the window frame or casement to have variations. Also, the window may not be perfectly square. The width of the blinds should be small enough to hang within the window frame without touching either side of the frame.

To determine the length (height) of the blinds, window height measurements are taken at the left and the right side of the windows. In one embodiment, approximately 10-14 inches of extra blind slats are provided at the bottom to accommodate cable deployment during a blast. This will allow approximately 5-7 inches of blast pressure venting space between the top header and vacated reinforced glass, as well as between the bottom footer and glass when the reinforced glass vacates the frame. The blinds preferably have enough extra slats to ensure that the blind coherent "net" is long enough to cover the entire detached window 110 upon full deployment of cables 18. The optimum spacing and/or strength of the restraint cables depends on blast engineering calculations. As the peak pressure and blast impulse increases, the size or number of cables will need to increase to meet the desired performance of the blind system. Likewise, as the window size increases, the size or number of anchors will also increase. The design components of the cable deployment length, spring length and the cable spacing are tightly interrelated and a change to one variable will require a change to the other two variables. For example, as the cable spacing decreases, the spring length must also decrease to keep the cable deployment length constant. The cables are preferably spaced evenly across the blinds, such as every 10-16 inches. The outermost cables are located approximately 3 inches from the ends of the blind header footer rails. The optimal spacing locations can be determined by a blast engineering analysis which considers the window size, the glass thickness, the glass type, the expected blast loading, the required blast hazard reduction level and other factors as necessary. In one embodiment, an even number of cables are spaced uniformly across the width of the blinds to simplify both the blast analysis and the blast blind system assembly process.

An exemplary assembly process can comprise an initial shop assembly phase and an onsite installation phase. An exemplary shop assembly phase is described below followed by the onsite installation phase.

Figure 8:
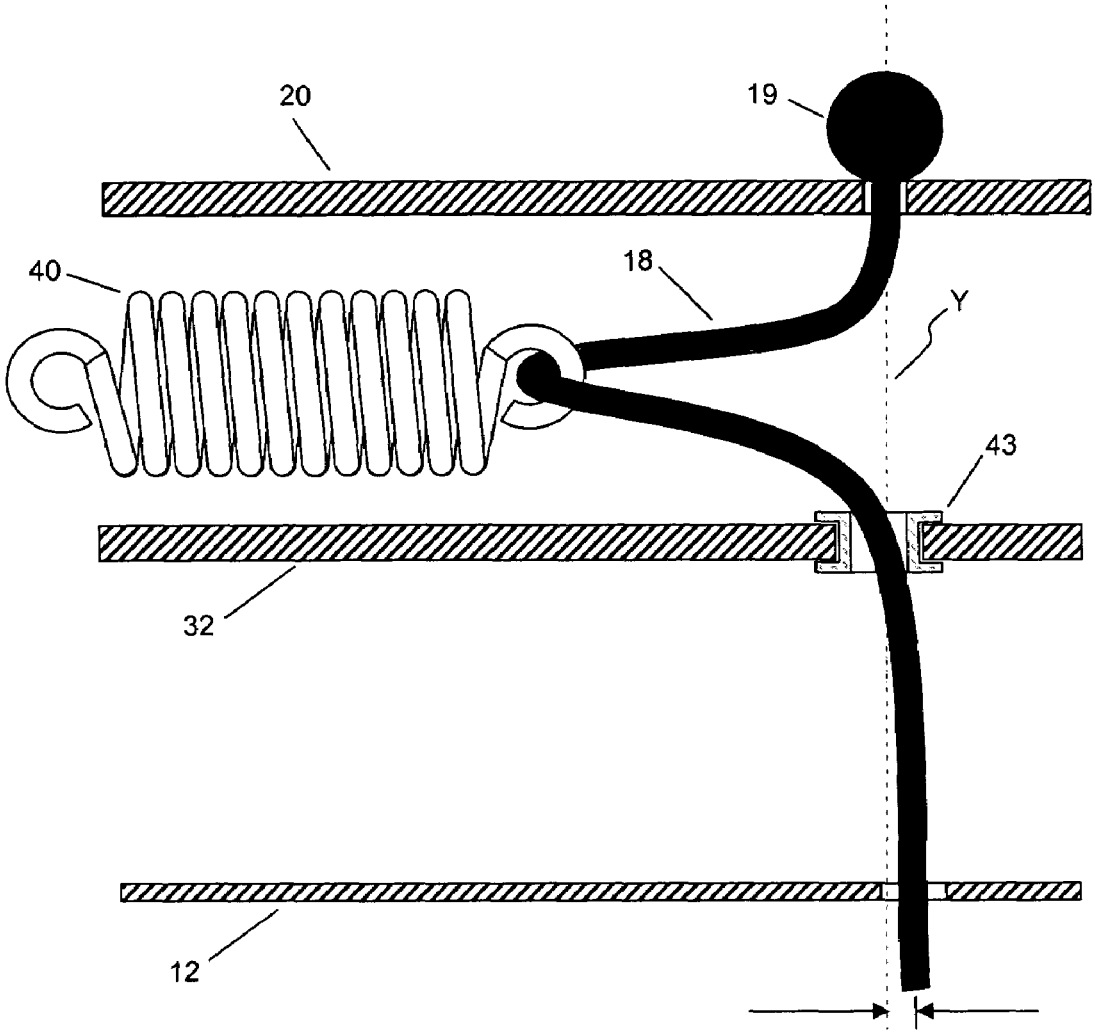
FIG. 8 is a partial frontal cross sectional view illustrating offset pass-through holes in the mounting enclosure and blind header rail of a blast resistant blind system.

In the shop assembly phase, the load bearing rails 20, 22 and mounting enclosures 32, 34 are cut to the same length as the blind header 12 and slats 14 (i.e., the window width minus 1"). Cable deployment holes are next drilled in the U-shaped mounting enclosures 32, 34, such as at ⅜ inch diameter. Hard vinyl or brass grommets are inserted in the holes to reduce friction during deployment of cables 18. The holes are large enough to allow the excess cable (which is held taut by the tensioning devices) to easily slip through the holes during the blast event. The holes are located to allow the cables to line up with the pass-through holes drilled into the blind header rail 12 and the blind slats 14. The placement of the holes should take into account the curvature of the cable when quiescent, such that the hole is slightly horizontally offset from the pass-through holes in the blind header 12. A ⅛" cable has some stiffness to it, even though generally supple. This stiffness creates curvature in the cable as it progresses from the tension spring 40 that should be accounted for in the construction. An example of the offset is shown by axis line Y in the partial frontal cross sectional view of FIG. 8. The offset is determined by the stiffness of the cable and the wall thickness of the friction-reducing grommet. With stiffer cables, the offset is increased to allow the cable to pass through the blind header rail 12 and blind slats 14 without binding against the pass-through holes.

The header rail 12 is next mounted to the enclosure 32 using the blind header rail mounting clip L-brackets 28 and low-profile self-drilling pan-head threaded fasteners. There should be a ⅛" gap between the header rail 12 and the mounting enclosure 32 to prevent binding of the blind tilting hardware (not shown). The end caps 36 are installed during the onsite installation phase.

Next, "swage-seating" holes, preferably 5/32 inch in diameter, are drilled in the load bearing rails 20, 22. These holes are formed just large enough to thread the cables 18 through them, but small enough to securely seat the cable ball swage 19 terminating each of the cable. These holes do not need to be aligned with the pass-through holes in the enclosures 32, 34. However, both the fabrication process and the cable-length calculations are simplified if the swage-seating holes are aligned with the pass-through holes in the enclosure 32, 34.

Oval slots are next drilled in the load bearing rails 20, 22 to accept the anchors, e.g., steel mounting studs. The size, type and spacing of the steel studs can be determined by the blast engineering analysis calculations. Slots, rather than circular holes, are used to allow for proper positioning and adjustment of the load bearing rails 20, 22 during the onsite installation. This allows some "play" in the installation process to account for imperfect locations and setting of the mounting studs.

Matching holes are also drilled in the front and back of both of the load bearing rails 20, 22 and mounting enclosures 32, 34, respectively, to allow these two components to be bolted together during the onsite installation process.

The steel cables are cut to the required length. One end of each cable is terminated using a ball swage or other swage or comparable cable termination. The "bitter" end (i.e., the non-swaged end) of the cable is threaded through the top load bearing rail 20, through the looped, crimped end of a tensioning spring 40, through the pass through holes of the top U-shaped mounting enclosure 32, blind rail 12, and slats 14, through the pass through holes of the bottom U-shaped mounting enclosure 34, through a corresponding bottom tensioning spring 40 and finally through the bottom load bearing rail 22 (or vice versa). A ball swage is then used to terminate this bitter end of the cable 18 to secure the end of the cable 18.

Since the cable could slide through the loop ends of the tension springs 40 before onsite installation and make onsite installation difficult, masking (or other) tape can be used temporarily to hold the loop in place. This tape can be removed (or allowed to tear) during final onsite assembly steps when the cables are stretched taut.

The blinds are preferably in a fully retracted position during the entire assembly, shipping and final installation processes.

During the onsite installation phase, a template can be used to ensure proper placement of drill holes into the top and bottom of the substrate (i.e., the window frame of the building wall) to receive the mounting studs/anchors. In most cases, it is expected that the anchor will be a ½-⅝ inch diameter threaded stud, embedded 2-3 inches into concrete and secured using a high strength epoxy, such as Hilti HIT HY 150 adhesive available from Hilti North America of Tulsa, Okla. When the studs are in place and the epoxy has hardened in accordance with the manufacturer's instructions, i.e., when all of the studs are fixed in place, the installation can continue.

First, the top load bearing rail 20 is bolted in place onto the anchors using a finger-tight connection. The installer should ensure that the rail 20 is square with the window frame and properly centered. If the window itself is not square, the rail 20 may need to be slightly off-center to allow the blinds to hang without touching either side of the window frame. Once the rail 20 is properly positioned, the nuts are tightened to the proper torque.

Next, the U-shaped mounting enclosure 34 is slid over the load bearing rail 20, while being careful to ensure that the cables and springs are properly positioned. The mounting enclosure 34 and upper rail 20 are then bolted together by inserted threaded fasteners 30 into the pre-drilled holes. With the exception of the end caps 36 the top mounting assembly 50 is completed.

The same installation procedure is then repeated for the bottom load bearing rail 22 and bottom mounting enclosure 36. Attaching the bottom mounting enclosure 36 to the bottom load bearing rail 22 will cause the cables to become taut as the cables engage and stretch the springs 40. One end of the mounting enclosure 36 is preferably attached first, followed by attachment of the second end of the mounting enclosure, allowing the installer to use leverage (as needed) to get the mounting enclosure 36 in place. The cable lengths are preferably selected so that the cables are taut enough to hang straight but not too tight to make installation difficult.

Next, the end caps 36, 38 are installed (i.e., slid over the mounting enclosures 32, 34 vertically) to cover the open ends of the mounting enclosures 32, 34 and to bridge the gap between the mounting assemblies 50, 52 and the window frame jambs. Preferably, there is about a ½ inch gap on either end of the mounting assemblies 50, 52. However, the gaps may not be equal if the window frames are not square. In one embodiment, the end caps are 1.5" wide to ensure that that any gaps are covered, i.e., the caps can be slid horizontally along the mounting enclosures 32, 34 to ensure proper coverage.

The blinds are then fully lowered and the blind footer rail 16 is optionally attached to the bottom mounting assembly 36 using, for example, self tapping screws. Snap-in plugs are then installed over the holes in the top of the footer rail 16 to hide the screws. In this embodiment, fastening the footer rail 16 to the bottom mounting assembly 52 keeps the blinds from being raised by the office occupant, which is important to allowing proper performance of the blast blinds during a blast event. The facility maintenance team can remove these screws and raise the blinds if access is required to the glass or frame members behind the blinds. Otherwise, in this embodiment, the blinds remain in their down position. Last, the proper operation of the blind tilt mechanism is tested.

The embodiment of the blast blind system 10 assembled and installed as described above having vertical retention cables 18 and horizontal blind slats 14 was tested by an independent blast engineering company. In the first test, a ¼-inch thick monolithic annealed glass (AG) pane reinforced with a 7-mil thick fragment retention film was fixed in a blast resistant aluminum frame. The above-described blast resistant blind system was installed and anchored to the window frame. The live blast test created a 4.81 psi pressure on the glass and an impulse duration of 30.23 psi-msec blast. The reinforced glass plane left the frame and landed 72 inches, with some small glass shards landing up to 318 inches, to the exterior of the structure outside the enclosure. Several glass fragments landed in the 3*a* to 3*b* performance condition region; that is, the fragments landed and stopped on the floor within 10 feet of the window opening.

In the second test, a ¼-inch thick monolithic AG pane reinforced with the 7-mil thick daylight fragment retention film was fixed in a blast resistant aluminum frame. Aluminum brake metal was installed along the interior window jambs. The above-described blast resistant blind system was installed and anchored to the window frame. The live blast test created a 4.79 psi pressure on the glass and an impulse duration of 30.58 psi-msec blast. The reinforced glass pane left the frame and landed 213 inches, with some small shards landing up to 356 inches, to the exterior of the test structure at the outside of the enclosure. No frame or anchorage failure was observed. Several fragments landed in the 3*a* to 3*b* performance condition region.

In summary, these tests showed that the blast blind retention system prevented the glass and film sheet from entering the enclosure. In some tests, the blast blind retention system incurred no damage from the blast except for a small ding in one of the slats and was reusable. The blast blind system was also reusable. It is the inventors understanding that no other blast product has been tested more than once, as the products are expected to be destroyed in a controlled manner.

The blast blind retention system was also tested by the British government at higher blast pressures above 10 psi. The glass was a standard ¼ inch annealed glass reinforced with a 7-mil thick fragment retention film. The same blast blind system was tested in three separate blasts. The blind system sustained no damage during these three tests, even though the same blind system was tested three times. The performance condition attained was the British equivalent of a U.S. General Services Administration Performance Condition 3 (also known as a "High Protection Level").

Figure 6:
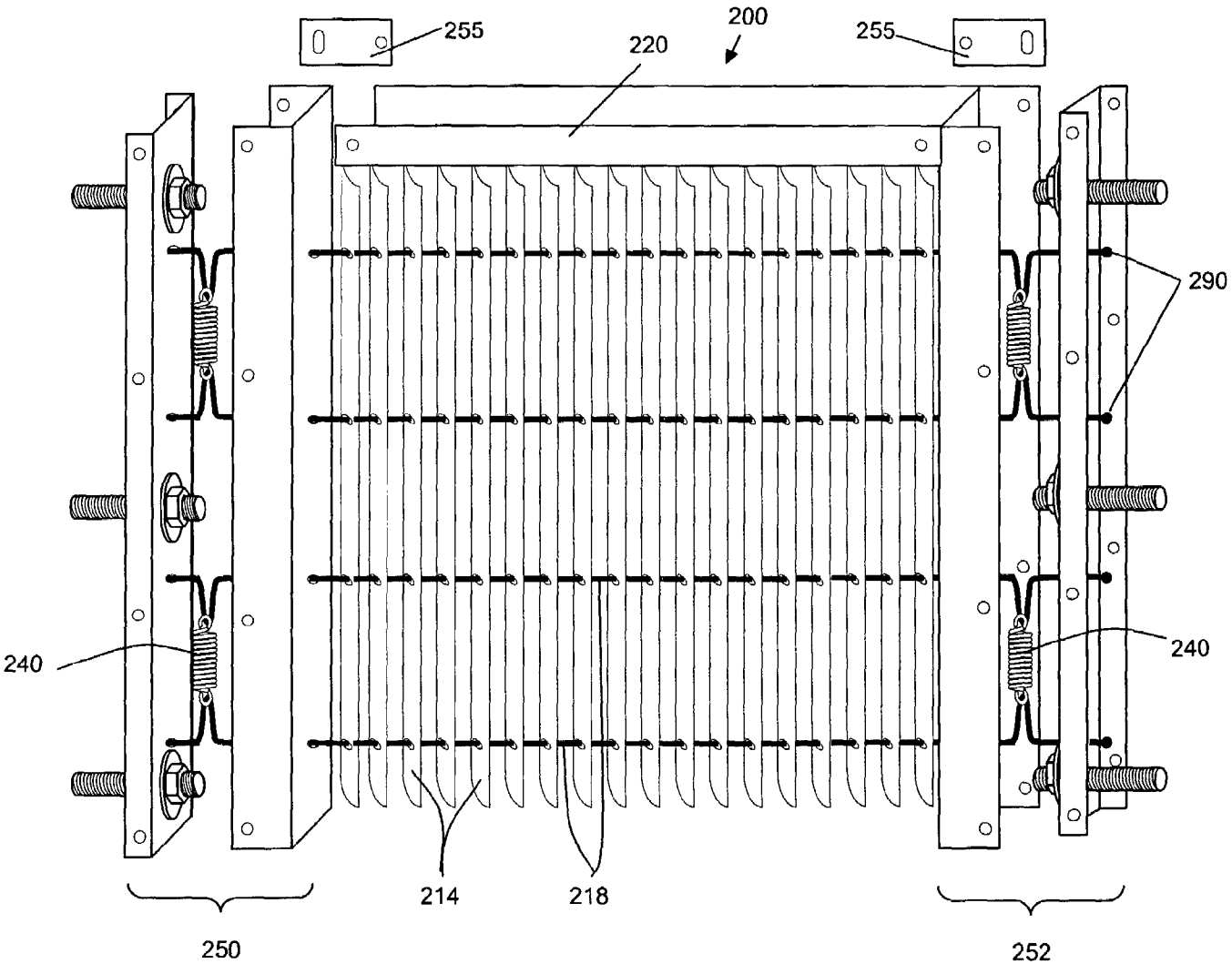
FIG. 6 is an exploded view of an embodiment of a blast resistant blind system having vertical slats and horizontal retaining cables.
Figure 7:
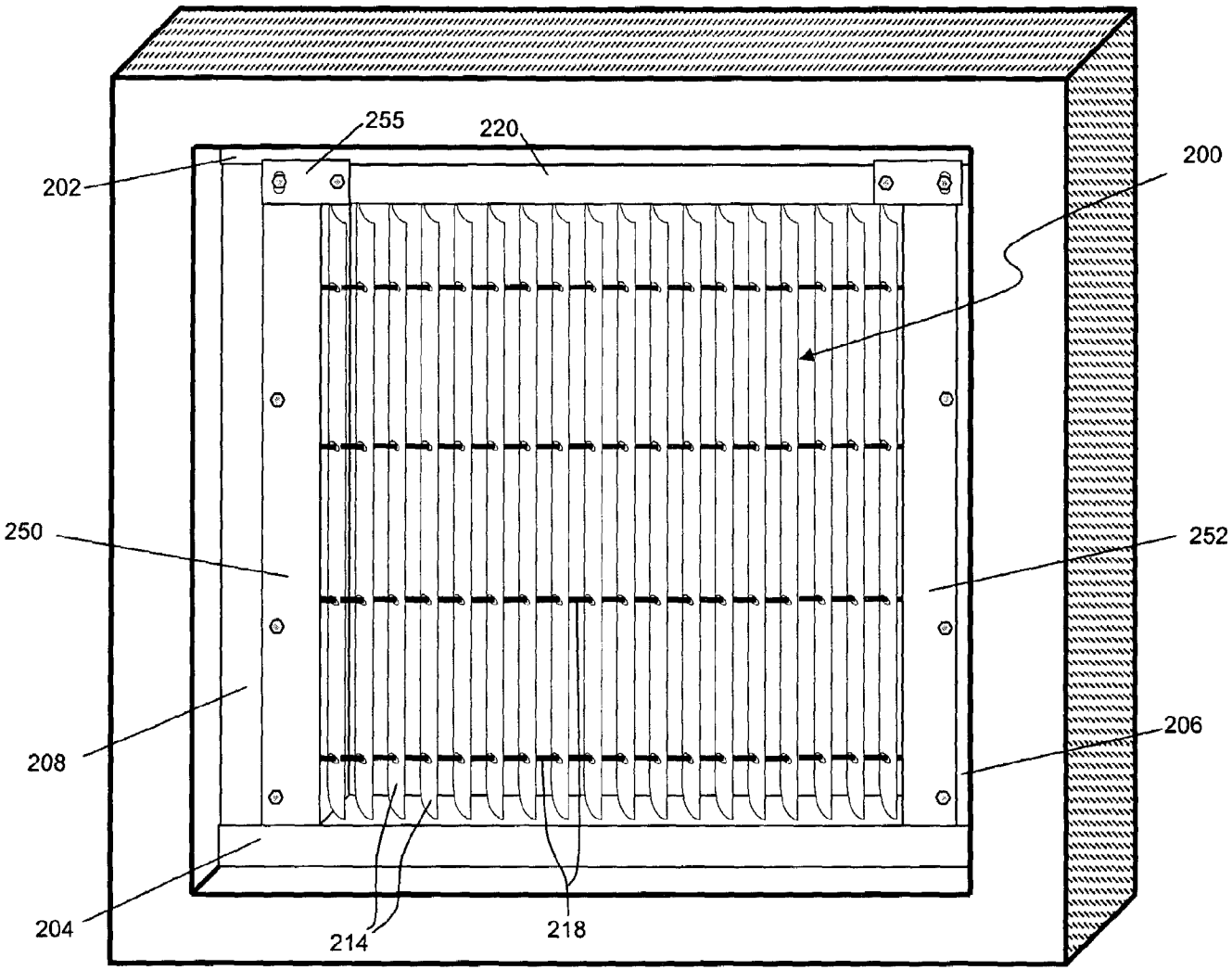
FIG. 7 is a perspective view of the blast resistant blind system of FIG. 6 installed in a wall of a structure.

FIG. 6 is front perspective, exploded view of an alternative embodiment of a blast resistant blind system 200 similar to blind system 10 but having vertical blind louvers or slats 214 and conventional vertical blind header rail 220 (which conceals components found in conventional vertical blind hardware familiar to those in the art, e.g., components for rotating and retracting the blinds) rather than horizontal blind slats and header. Components for retracting the blinds may be provided, such as for allowing maintenance access to the window and may, optionally, be locked to prevent unauthorized use. Optionally, the blind system has no components for retracting the blinds, ensuring that the blinds cover the window in the event of a blast. A plurality of horizontal retention cables 218 extend through the vertical blind slats 214, with adjacent cables 218 coupled together with a tensioning device 240, such as the tensioning springs described above. The ends of the cables can be swaged using ball swages 290, as described above in connection with FIGS. 1-2. The mounting enclosures 250 and 252 can be configured similar to those described above in connection with FIGS. 1-2, i.e., with a load bearing rail, enclosure and end caps, although they are vertically oriented and coupled to the jamb portions of an opening in a wall. Anchors are also provided, although not shown. The plates 255 shown above the drawings are cosmetic and may be used to cover any gap between 1) left and right mounting assemblies 250, 252 and the existing header frame, and 2 the mounting assemblies 250, 252 and the blinds header 220. FIG. 7 shows system 200 installed in an opening in a wall including header and footer portions 202, 204 and jamb portions 206, 208. The system 200 operates in the same manner as system 10 described above, and the same factors are considered in material selection, component sizing and spacing.

Although FIGS. 1 and 2 and FIGS. 6 and 7 illustrate embodiments where the panel engaging member are orthogonal to the blind slats, it is contemplated that in some embodiments, these panel engaging members may be oriented parallel to, and extend through, the blind slats, although such embodiments may require more panel engaging members to provide a substantially continuous net to catch the window pane as described above.

From the foregoing, an exemplary blast resistant blind system is provided to prevent window glass from entering the interior of a structure during a blast event, thereby minimizing potential injury caused by glass and window component projectiles. The blast resistant blind system advantageously includes a conventional window blind system, which provides for an aesthetic appearance and helps hide the retention cables. The system can be installed over an existing window system to catch blown glass while allowing effective venting of the overpressure of the blast. The incorporation of a blind system with pane engaging members such as retention cables allows the blast resistant blind system to fully engage the blown glass panel during the blast event, transferring the tensile load to the structure, thereby stopping the glass, and evenly distributing the stopping force across the surface of the protection film, thereby preventing localized tearing and multiple projectiles.

Although it is preferred that the cables are disposed in part through at least some of the blind slats, it is contemplated that the assembly could, from outside to inside, be window pane/blind slats/cables, with the blind slats disposed between the window pane and cables and the cables not extending through the blind slats. However, this embodiment may be less aesthetically pleasing and may require additional cables to achieve the same strength.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention

What is claimed is:

1. A blast resistant window blind system installed over a reinforced window pane supported by a window framework mounted in an opening in a wall of a structure, said window pane having an inside surface facing an inside of said structure and an outside surface facing an outside of said structure, comprising:

a blind system comprising a plurality of parallel blind slats;

a plurality of spaced pane engaging members disposed to extend across the inside surface of said window pane;

first and second mounting bodies secured to said pane engaging members and configured to couple to anchor members disposed at first and second opposite ends of said opening, wherein said mounting bodies are fixedly secured to the anchor members to anchor the mounting bodies to the wall of the structure, said anchor members extending through a mounting body surface of said mounting bodies and secured thereto with fasteners, whereby said pane engaging members are coupled to said structure;

and a plurality of energy dampening devices coupled to said pane engaging members, each of said energy dampening devices allowing said pane engaging members to extend a selected amount toward said inside of said structure upon impact of said window pane during a blast event, wherein said blind system and pane engaging members cooperate to restrain said window pane from being blown into the inside of said structure and conform to the inside surface of said window pane during impact therewith to distribute the restraining force across the inside surface of said window pane, wherein individual ones of said energy dampening devices are coupled between adjacent pane engaging members, wherein said pane engaging members comprise a plurality of steel restraint cables, and adjacent restraint cables are coupled together with at least a pair of energy dampening devices, and wherein each of said energy dampening devices comprises a tension spring having opposite ends thereof coupled between adjacent restraint cables.

2. The blast resistant window blind system of claim 1, wherein said pane engaging members and blind slats extend generally orthogonally to one another, said pane engaging members extending through at least some of said blind slats.

3. The blast resistant window blind system of claim 1, wherein at least one energy dampening device is coupled to each pane engaging member.

4. The blast resistant blind system of claim 1, further comprising at least one U-shaped mounting enclosure coupled to one of said first and second mounting bodies for housing at least some of said energy dampening devices.

5. The blast resistant blind system of claim 1, wherein said mounting bodies comprises U-shaped rails.

6. The blast resistant window blind system of claim 1, wherein said pane engaging members are substantially taut when said blind system is installed and said window blind system is in its quiescent state.

7. A blast resistant window blind system installed over a reinforced window pane supported by a window framework mounted in an opening in a wall of a structure, said window pane having an inside surface facing an inside of said structure and an outside surface facing an outside of said structure, comprising:

a blind system comprising a plurality of parallel blind slats and a blind header;

a plurality of spaced restraint cables disposed to extend across the inside surface of said window pane, said cables extending orthogonally to said blind slats and extending through at least some of the blind slats;

first and second mounting rails secured to said restraint cables and configured to couple to anchor members disposed at first and second opposite ends of said opening, wherein said mounting rails are fixedly secured to the anchor members to anchor the mounting rails to the wall of the structure, said anchor members extending through the mounting rails and secured thereto with fasteners, whereby said restraint cables are coupled to said structure, and a plurality of tensioners coupled to said restraint cables, individual ones of said tensioners disposed between and orthogonal to adjacent restraint cables, the tensioners allowing said restraint cables to extend a selected amount toward said inside of said structure upon impact of said window pane during a blast event, wherein said blind system and restraint cables cooperate to restrain said window pane from being blown into the inside of said structure and conform to the inside surface of said window pane during impact therewith to distribute the restraining force across the inside surface of said window pane, wherein said tensioners comprise a plurality of tension springs having opposite ends coupled between adjacent restraint cables.

8. The blast resistant window blind system of claim 7, wherein said blind system comprises horizontal blind slats, blind header and footer rails, and blind slat tilting hardware.

9. The blast resistant window blind system of claim 8, wherein said footer rail is secured to one of said mounting rails proximate to said footer.

10. The blast resistant window blind system of claim 8, wherein adjacent restraint cables from said plurality of restraint cables are coupled together by at least a pair of tensioners, a first one of said tensioners from said pair of tensioners being above a bottommost one of said horizontal blind slats and second one of said tensioners from said pair of tensioners being below a topmost one of said horizontal blind slats.

11. The blast resistant blind system of claim 8, wherein said blind system comprises additional horizontal blind slats in addition to those need to cover said window pane when said system is installed and in a quiescent state so that said plurality of blind slats can substantially conform to the inside surface of said window pane during extension of said cables toward the inside of said structure during impact.

12. The blast resistant window blind system of claim 7, wherein said restraint cables are substantially taut when said blind system is installed and said window blind system is in a quiescent state.

13. The blast resistant window blind system of claim 7, further comprising first and second U-shaped mounting enclosures coupled to said first and second mounting rails for housing said plurality of tensioners.

14. The blast resistant blind system of claim 7, wherein said mounting rails comprises U-shaped rails.

15. The blast resistant blind system of claim 7, wherein said restraint cables are secured to said mounting rails with swages.

16. A blast resistant window system, comprising:

a window pane reinforced with a blast protection film, said window pane supported by a window framework mounted in an opening in a wall of a structure, said window pane having an inside surface facing an inside of said structure and an outside surface facing an outside of said structure; and a blast resistant window blind system comprising:

a blind system comprising a plurality of parallel blind slats and hardware for tilting said blind slats;

a plurality of spaced pane engaging members disposed to extend across the inside surface of said window pane;

first and second mounting bodies secured to said pane engaging members and coupled to anchor members disposed at first and second opposite ends of said opening, wherein said mounting bodies are fixedly secured to the anchor members to anchor the mounting bodies to the wall of the structure, said anchor members extending through a mounting body surface of said mounting bodies and secured thereto with fasteners, whereby said pane engaging members are coupled to said structure; and a plurality of energy dampening devices coupled to said pane engaging members, said energy dampening devices allowing said pane engaging members to extend a selected amount toward said inside of said structure upon impact of said window pane during a blast event, wherein said blind system and pane engaging members cooperate to restrain said window pane from being blown into the inside of said structure and conform to the inside surface of said window pane during impact therewith to distribute the restraining force across the inside surface of said window pane, wherein individual ones of said energy dampening devices are coupled between adjacent pane engaging members, wherein said pane engaging members comprise a plurality of restraint cables, and adjacent restraint cables are coupled together with at least a pair of energy dampening devices, and wherein each of said energy dampening devices comprises a tension spring having opposite ends thereof coupled between adjacent restraint cables.

* * * * *